United States Patent [19]

Heimburg et al.

[11] 4,210,995

[45] Jul. 8, 1980

[54] METHOD OF CONSTRUCTING A BURNER

[76] Inventors: Richard W. Heimburg, 831 Ackerman Ave.; Donald M. Stewart, 104 Robert Dr., both of Syracuse, N.Y. 13210

[21] Appl. No.: 957,548

[22] Filed: Nov. 3, 1978

Related U.S. Application Data

[62] Division of Ser. No. 832,191, Sep. 12, 1977, Pat. No. 4,132,179.

[51] Int. Cl.[2] ..... B23P 15/00; F23G 3/00

[52] U.S. Cl. ..... 29/157 R

[58] Field of Search ..... 29/157 R, 157 C; 110/210–214, 110, 106, 344, 345, 347

[56] References Cited

U.S. PATENT DOCUMENTS

| | | | |
|---|---|---|---|
| 2,725,950 | 12/1955 | Christiansen | 110/212 |
| 3,043,249 | 7/1962 | Hebert et al. | 110/211 |
| 3,651,771 | 3/1972 | Eberle | 110/213 |
| 3,653,344 | 4/1972 | Masek et al. | 110/212 |
| 3,707,128 | 12/1972 | Lang | 110/211 |
| 3,774,555 | 11/1973 | Turner | 110/210 |
| 3,780,674 | 12/1973 | Liu | 110/212 |
| 3,808,986 | 5/1974 | Logdon | 110/210 |
| 4,075,953 | 2/1978 | Sowards | 110/347 |

*Primary Examiner*—Daniel C. Crane

*Attorney, Agent, or Firm*—Bruns & Jenney

[57] ABSTRACT

A method of constructing a burner for efficiently burning a wide variety of fuels without having to add auxiliary fuel to the system or provide special air handling equipment. In the main embodiment of the invention, two cylindrical burning sections are superimposed one over the other in a cross-like configuration. The lower cylinder serves as a primary burning chamber in the system while the upper cylinder serves as an afterburner. A conveyor transports raw fuel from the front of the primary chamber through an extended burning zone. The rear of the chamber remains open to the atmosphere so that air is drawn over the moving fuel bed in the burning zone in counterflow relationship therewith. An elongated duct is aligned within the primary chamber over the burning bed of fuel and is arranged to accelerate volatile gases generated in the primary chamber into the afterburner. The angular relationship between the two cylinders is adjusted so that the turbulent vortical flow is created in the afterburner.

5 Claims, 5 Drawing Figures

METHOD OF CONSTRUCTING A BURNER

BACKGROUND OF THE INVENTION

This application is a division of application Ser. No. 832,191, filed Sept. 12, 1977, now U.S. Pat. No. 4,132,179, issued Jan. 2, 1979 in the name of the same inventor.

This invention relates to means for efficiently burning a wide variety of fuels without the addition of auxiliary fuels or the need for special air handling equipment.

In light of the relatively strict standards presently being imposed by many government agencies, it is important to control the amount of pollution contained in stack gases when burning all types of fuels. One approach has been to place precipitators in the flue or stack of the burner and physically capture the pollution producing materials prior to their discharge into the atmosphere. This technique, however, generally involves complex and relatively expensive equipment. A less costly method of achieving clean effluents is to provide for thorough or complete combustion of the fuel in the burner before admitting exhaust gases to the stack.

Most recent devices for accomplishing complete combustion utilize a two step burning process wherein each step is carried out independently in a separate isolated chamber. Initially, in the first chamber, the raw fuel is generally burned using somewhat less than one hundred percent theoretical air in order to minimize flyash lofting. The combustible gases driven off during primary burning are collected and delivered to the second chamber where they are typically mixed with auxiliary fuel and air to insure complete burning. The mixture may also be acted upon by blowers and/or flow diverters to establish a turbulent flow to further insure that the high temperatures required for complete burning are maintained in this section.

Although the two step burning process affords many advantages over other known processes, its full potential has, heretofore, never before truly realized simply because the operation of the two sections involved have never been brought together to provide for a self-sustaining fully augmented system.

SUMMARY OF THE INVENTION

It is therefore an object of the present invention to improve the performance of two stage burners.

A further object of the present invention is to provide a method of constructing a burner wherein a primary burning stage and a secondary burning stage are integrated in a manner to provide clean and efficient burning of a wide variety of fuels.

Yet another object of the present invention is to achieve relatively complete burning of typically dirty fuels without the need of special equipment or the addition of auxiliary fuel to the system.

A still further object of the present invention is to provide a method of constructing a burner that is simple to carry out and wherein the burner relies upon a natural draft to produce a self-regulating high temperature combustion of a wide variety of fuels.

These and other objects of the present invention are attained by a method of constructing a burner wherein the burner includes a primary burning chamber formed of an open ended cylinder having a conveyor operatively associated therewith for bringing a supply of fuel from the front of the cylinder through a primary burning zone in counterflow relationship with air drawn into the chamber through its open rear end. A flow accelerator and heat amplifier, in the form of an elongated duct, is positioned in the chamber over the primary burning zone. The exit of the duct is arranged to discharge outside of the chamber over the point where fuel enters the burning zone. In one embodiment of the invention an afterburner is connected to the discharge of the duct of receive volatile gases discharged therefrom and turn the gas stream into a turbulent vortical flow capable of promoting extremely high temperatures whereby the gases exhausted from the afterburner are polished.

BRIEF DESCRIPTION OF THE DRAWINGS

For a better understanding of the present invention as well as other objects and further features thereof, reference is had to the following detailed description of the invention to be read in conjunction with the accompanying drawings, wherein.

DESCRIPTION OF THE PREFERRED EMBODIMENT

Figure 1:
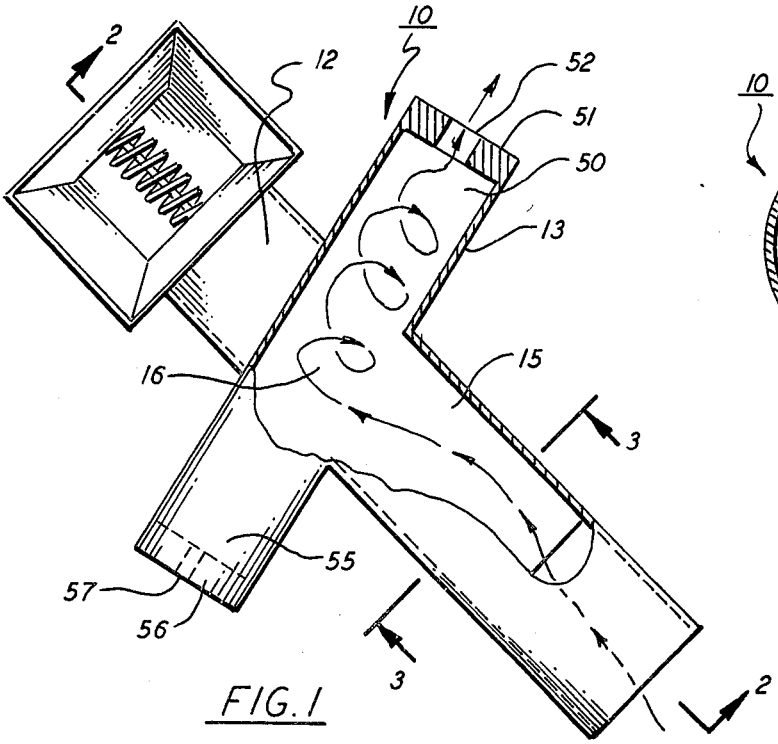
FIG. 1 is a top plan view of a burner embodying the teachings of the present invention with portions broken away to more clearly illustrate the flow of gases through the burner sections.
Figure 3:
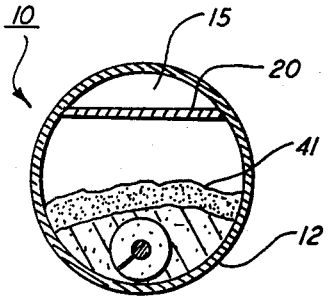
FIG. 3 is a sectional view of the burner illustrated in FIG. 1 taken along lines 3—3 in FIG. 1.
Figure 2:
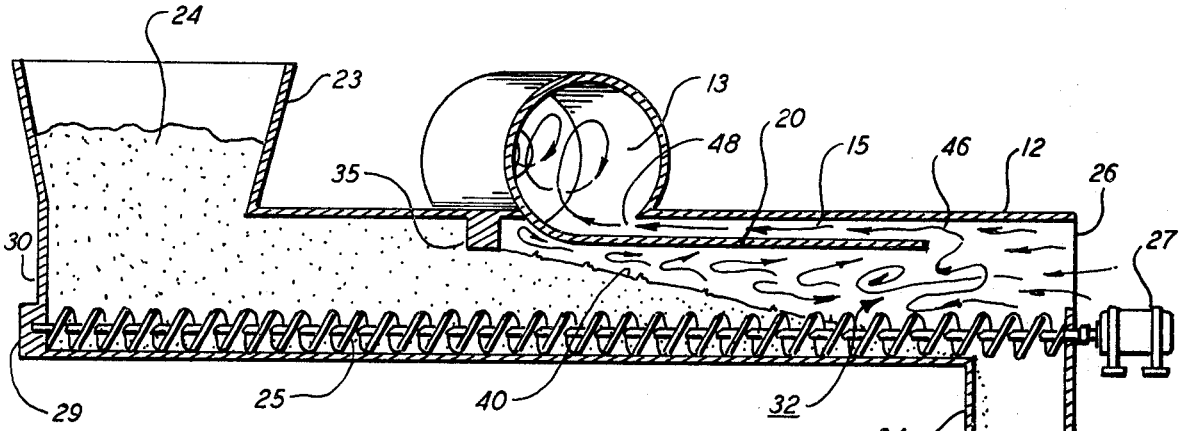
FIG. 2 is an enlarged sectional view of the burner illustrated in FIG. 1 taken along lines 2—2 in FIG. 1.

Referring initially to FIGS. 1-3, there is shown a burner assembly, generally referenced 10, incorporating the teachings of the present invention. The burner, when compared to most two stage burners used in the art, is of simple construction that includes a primary burning chamber 12 (primary stage) and an afterburner 13 (secondary stage) that are interconnected by a combined flow accelerator and heat amplifier which, in this particular embodiment, is an elongated duct 15 of relatively constant area. In operation, the burner is adapted to carry out a two step burning process utilizing a wide variety of fuels, such as solids, liquids or slurries, without the need of using fuel metering devices, gas cleaning equipment or separate oxidants as conventionally employed in this type of installation. Raw fuel is initially burned in the primary stage with an abundance of air and the volatile gases generated in this stage are then accelerated through the duct into the afterburner. Typically, the gases contain pyrolyzing and burning materials and continue to burn from initial ignition in the primary stage until complete burnout is reached in the afterburner. The afterburner is physically positioned in reference to the primary stage to promote high temperature turbulent burning of the gases again utilizing natural draft.

Both the primary and secondary stages are fabricated of a metal shell capable of withstanding the burning temperatures involved. The two stages are herein shown as extended hollow cylinders at the region of intersection so that when the two stages are assembled they share a common opening 16 thus placing the interior of one cylinder in communication with the other. The cylinders are welded together about the margin of the opening. The weld seals the opening and also supports the two cylindrical stages in alignment whereby the two stages lie in parallel planes.

The duct 15 is positioned within the primary burning chamber and is arranged to accelerate the flow of volatile gases moving between stages and to amplify the heating effect in the primary chamber without promoting flyash lofting or the addition of auxiliary equipment. The flow stream is typically made up of the products of initial combustion and air. The duct is formed by joining a plate 20 along the top of the primary burning chamber wherein the plate and the arcuate inner wall of the chamber cooperate to establish an extended passageway leading from entrance 46 at the rear of the chamber to an exit 48 at the common opening between cylinders. In assembly, the duct is positioned in parallel alignment with the axis of the primary chamber.

Fuel 24 is brought into the primary burning chamber through the open front end thereof by the combined action of a supply hopper 23 and an auger 25. The inclined side walls of the hopper direct fuel into the front of the cylinder where it is picked up by the auger and moved through primary burning zone 32. The auger is supported at one end in a bearing block 29, which is carried by side wall 30 of the hopper, and is coupled to a drive motor 27 at the opposite end. The auger runs along the bottom of the chamber and is sized to provide ample space within the burning zone between itself and the lower wall 20 of the duct. The motor is located outside of the chamber well back from the burning zone to prevent it from being thermally damaged when the burner is in operation. Although a hopper and auger fuel feeding arrangement is shown herein, it should be understood that the invention is not limited to this specific structure and any suitable feeding equipment capable of moving a supply of fuel through the burning zone may be employed. The present burner is generally insensitive to the nature of the fuel being processed and a wide variety of fuels can be efficiently burned therein. Selection of the fuel handling equipment may be dictated by the nature of the in process fuel.

The above noted burning zone 32 extends generally from restrictor baffle 35 to the ash drop 34. The restrictor is located along the top surface of the chamber wall just forward of the common opening formed between the stages. The restrictor narrows the fuel entrance area to the burning zone and serves to dispense fuel evenly into this region. Under the influence of the conveyor, fuel packed into the front end of the chamber is transported at a controlled rate through the burning zone. For explanatory purposes it will be assumed that the fuel experiences ignition while passing through the restricted region, although in practice initial ignition can take place on either side of this region without adverse effects. Fuel passing through the burning zone 32 is consumed and the volume of fuel decreases proportionally. Accordingly, an inclined flame front 40 running from the restrictor 35 to the ash pit 34 is supported within the burning zone.

As noted, the rear end 26 of the primary chamber 12 is open to atmosphere and a steady stream of air for supporting combustion is permitted to move under natural draft conditions into the burning zone. The unrestricted flow of air washes over the inclined bed of fuel in a counterflow relationship therewith causing the flame front to walk up the incline toward the front of the burning zone. Gas velocities about the ash drop region are held to a minimum within this critical region thereby discouraging flyash lofting. By the same token, the gas velocity increases as it moves toward the front of the burning region to enhance ignition and aid initial burning of raw fuel entering the region.

It should be further noted that some combustion air is also being drawn into the burning zone from the front of the chamber through the porous bed of fuel. This slight forward flow of air prevents flashbacks from occurring and suppresses the generation of unwanted fuel odors in and about the hopper region. This latter feature is highly desirous when processing solid waste material in the burner.

As best seen in FIG. 3, a pyrolysis region 41, containing burning and unburnt materials, is created directly over the bed of ignited fuel. Air, entering the chamber through the back thereof, is mixed with the materials to form a relatively unstable volatile mixture of gases capable of supporting further combustion. In order to complete the combustion process and thus promote clean effluents at the exhaust end of the burner, the gases are directed through duct 15 into the afterburner where they are polished.

The volatile gases generated in the primary chamber rise to the top of the chamber and are drawn into the entrance 46 of the duct. As illustrated in FIG. 2, the duct entrance faces the open end of the primary cylinder and is positioned to accept a further supply of combustion air. As a result, the entering gas flow continues to burn as it moves along the duct toward the exit 48. The burning gases, rapidly expanding within the constant area duct passage, are consequently accelerated into the afterburner. The afterburner is angularly offset slightly from the perpendicular in regard to the primary chamber and the entering gas stream is turned by the interior wall of the afterburner into a vortical flow. Due to the high velocities generated in the duct, the flow in the afterburner becomes a swirling, highly turbulent mass, as it moves toward the exhaust end 50 thereof.

The exhaust end 50 of the afterburner is provided with a cap 51 containing one or more openings 52 for controlling the release of gases from this stage. The dynamic pressure downstream of the end cap 51 is maintained at a pressure level that is the lowest in the system by means of a chimney or induced air fan (not shown). This, in turn, provides the motive force, through natural draft conditions, to establish the required flow of gases through the system. The opposite or supply end, 55 of the afterburner is similarly provided with an end cap 56 having one or more air entrance ports 57 which are tuned to allow a metered amount of air into the second stage afterburner to enhance its operation.

By creating a turbulent flow, as described above, within the afterburner extremely high temperatures are attained and the resident time at which the gases remain at these high temperatures is considerably lengthened without the need of providing for an overly generous afterburner area.

The operation of both sections of the burner is closely coordinated and integrated by means of the duct 15 to provide a self-sustaining compact installation capable of effectively combusting to completion a wide variety of fuels. Although relatively simple in construction, the duct carries out a number of important functions relative to both stages which contributes greatly to the efficient overall performance of the burner.

The duct acts as a heat exchange in regard to the primary stage to transfer energy from the burning high temperature gases passing therethrough back into the primary burning zone through the bottom wall 20 of the duct. By design, the flow of gases through the duct is from the rear of the primary burning zone toward the front. Consequently, the relatively cooler fuel moving into the burning zone is exposed to a higher temperature flow than the spent fuel at the rear of the chamber. The conductive heat flow into the primary chamber is thus distributed in a manner for best promoting effective ignition and burning of the raw fuel.

The geometry of the primary burning chamber is also selected so that the cavity exhibits black body characteristics. The bottom wall 20 of the duct is positioned in the cavity so that radiant energy developed within the cavity is reflected or reradiated back into the burning zone. The combined effect of the radiant and conductive heat transfer mechanisms is to amplify the burning operation within the primary stage without having to augment the burner's activities from an outside source.

In operation, the duct effectively extends the length of the afterburner without consuming space or increasing the overall size of the equipment. In effect, the duct provides a premixing zone for the products of combustion produced in the primary stage and further combustion air. Generally, the second stage burning process is commenced within the duct and is well established prior to the mixture being discharged into the afterburner. In point of fact, under certain conditions, complete burning can be accomplished in the duct and the afterburner eliminated thereby further reducing the size of the burner without sacrificing performance. Normally, however, particularly when handling relatively dirty fuels, the afterburner will be required to achieve complete burning.

The duct further functions as a nozzle to accelerate the flow discharged into the afterburner. To this end, the duct can be constructed so that it converges from the entrance 46 toward the exit 48. The combined effect of the converging passage and expanding gases is to further increase the flow velocity and thus the turbulence of the flow directed into the afterburner. This can be simply accomplished by inclining the bottom wall of the duct.

Figure 4:
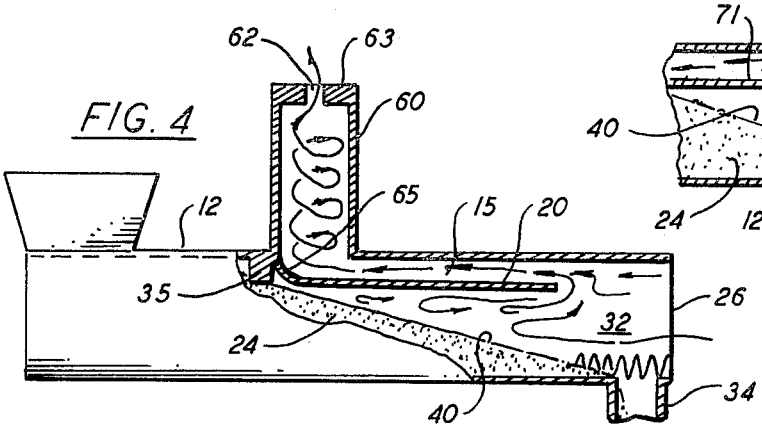
FIG. 4 is a side elevation in section showing a further embodiment of the present invention in which the afterburner stage is positioned in vertical alignment above the primary burning stage.

Referring now to FIG. 4, there is shown another embodiment of a burner assembly employing the teachings of the present invention. In this arrangement, the afterburner stage 60 is supported in vertical alignment upon a horizontally situated primary burning chamber 12. The primary section functions as described above and like numbers represent like components. The terminal end of the stack-like afterburner contains a cap 63 having one or more openings 62 for allowing the spent gases to be exhausted from the burner. The transition or discharge region between the afterburner and the duct is provided with a tongue 65 that slopes upwardly to direct the flow into the afterburner. The tongue cooperates with the inner wall of the afterburner to shape the incoming flow stream into a swirling vortex that is directed upwardly toward the opening 62. In this configuration, the vertically extended afterburner produces a chimney effect and can be conveniently connected to a conventional stack to deliver low static pressures at the exhaust end of the system.

Figure 5:
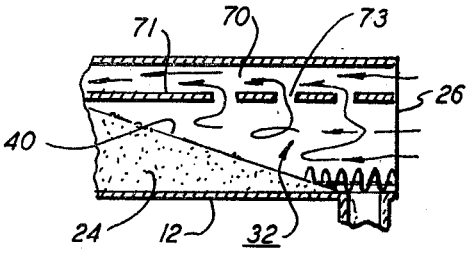
FIG. 5 is a partial view in section showing the rear portion of the primary burning stage and further illustrating an alternate arrangement of the flow accelerator and heat amplifier section connecting the two stages.

FIG. 5 illustrates an alternative construction of the transition duct connecting the two main stages of the burner. The duct 70, which functions in the manner described above, is extended to bring the rear opening thereof out to the end of the primary chamber 12. Combustion air is thus permitted to enter the duct directly through the rear opening 26 in the chamber. A plurality of inlet gas ports 73 are strategically located in the bottom wall 71 of the duct to meter a controlled flow of combustion gases from the primary burning zone into the duct passage.

As can be seen from the above description, the present burner processes fuel on a first in first out basis within a relatively long, narrow, burning zone. Gases generated by the primary burning operation are carried over the burning fuel bed to establish some afterburning early on in the process. The counterflow configuration encourages premixing of gases in the primary chamber and, because of the relatively low velocities involved, suppresses flyash lofting within the chamber. Burning can be accomplished in the primary stage at relatively low temperatures thereby permitting the conveyor, and other component parts, to be constructed of ordinary materials rather than high priced alloys.

It should also be clear from the present disclosure that sufficient air for supporting combustion in all sections of the burner is provided by natural draft and, as a result, stable burning conditions can be maintained when the system is experiencing relatively large fluctuations in fuel flow rates. The nature of the gases generated in the system, however, remain relatively unchanged during these periods thus assuring satisfactory ignition and burning of the volatile materials.

While this invention has been described with reference to the structure disclosed herein, it is not confined to the details set forth, and this application is intended to cover such modifications or changes as may come within the scope of the following claims.

We claim:

1. The method of constructing a self-sustaining burner for efficiently processing a wide variety of fuels including positioning an open ended, generally tubular primary burning section in a horizontal plane so that fuel is able to enter the primary chimney section through one end and combustion air through the opposite end thereof, obliquely joining a tubular afterburner section on top of said primary burning section with the axes of both sections crossing at about the midlength region of the primary burning section, forming a common opening between the sections at about the crossover region of the axes whereby combustion gases generated in the primary burner section are able to flow into the afterburner section, and positioning an elongated duct in the primary burning section that encloses the common opening and which extends axially toward said opposite end of the primary burning section whereby combustion gases are accelerated as they move toward said opening.

2. The method of claim 1 that further includes the step of mounting a screw conveyor axially along the bottom of the primary burning section to move fuel from said one end toward said opposite end thereof.

3. The method of claim 1 wherein the duct is of general uniform cross-sectional area along its axial length.

4. The method of claim 1 wherein the cross-sectional area of the duct converges along its axis toward the opposite end of the primary burning chamber.

5. The method of claim 1 wherein the axes of both sections are horizontally aligned and are offset at some engle less than 90°.

* * * * *

UNITED STATES PATENT AND TRADEMARK OFFICE

CERTIFICATE OF CORRECTION

PATENT NO. : 4,210,995

DATED : July 8, 1980

INVENTOR(S) : RICHARD W. HEIMBURG & DONALD M. STEWART

It is certified that error appears in the above–identified patent and that said Letters Patent are hereby corrected as shown below:

Col. 2, line 8, last word "of" should be -- to --;

Claim 1, line 39, "chimney" should be -- burning --; and

Claim 5, line 67 "engle" should be -- angle --.

Signed and Sealed this

*Seventh* Day of *October 1980*

[SEAL]

*Attest:*

SIDNEY A. DIAMOND

*Attesting Officer*

*Commissioner of Patents and Trademarks*